United States Patent [19]

Saeki et al.

[11] Patent Number: 4,932,389

[45] Date of Patent: Jun. 12, 1990

[54] SLICING APPARATUS WITH WORK-FEEDING MECHANISM IN FEEDBACK CONTROL

[75] Inventors: Yukihiro Saeki, Kawasaki; Masatoshi Tagami, Tokyo, both of Japan

[73] Assignee: Mitsubishi Kinzoku Kabushiki Kaisha, Tokyo, Japan

[21] Appl. No.: 260,200

[22] Filed: Oct. 20, 1988

[30] Foreign Application Priority Data

Oct. 21, 1987 [JP] Japan ..... 62-265920

[51] Int. Cl.[5] ..... B28D 1/10

[52] U.S. Cl. ..... 125/13.01; 125/35; 51/73 R; 51/165.71; 51/165.9

[58] Field of Search ..... 51/73 R, 165.71, 165.77, 51/165.9, 165.92; 125/13 R, 14, 35; 83/72, 74

[56] References Cited

U.S. PATENT DOCUMENTS

| | | | |
|---|---|---|---|
| 3,039,235 | 6/1962 | Heinrich | 51/73 R |
| 4,228,782 | 10/1980 | Demers et al. | 51/73 R X |
| 4,420,909 | 12/1983 | Steere | 51/73 R |
| 4,633,847 | 1/1987 | Lossl et al. | 51/73 R X |
| 4,653,361 | 3/1987 | Zobeli | 51/165.77 X |

*Primary Examiner*—Robert P. Olszewski
*Attorney, Agent, or Firm*—Scully, Scott, Murphy & Presser

[57] ABSTRACT

A slicing apparatus includes: an annular plate-like rotary blade adapted to be rotated about an axle thereof and having an inner peripheral cutting edge; a table for carrying a work; a first work-feeding mechanism for moving the work on the table in a direction parallel to the axis of the rotary blade; and a second work-feeding mechanism for moving the table in a direction parallel to the opposite side of the blade so as to cause the work on the table to be sliced by the blade. The second work feeding mechanism includes: a hydraulic cylinder operatively connected to the table; a pressure oil-supplying mechanism for supplying the hydraulic cylinder with a pressure oil; a rotary valve for controlling the flow rate of the pressure oil to be supplied to the hydraulic cylinder, the rotary valve having a rotary input shaft of which rotational position determines the flow rate of the pressure oil passing through the rotary valve; a drive mechanism for rotating the input shaft of the rotary valve; a cutting speed sensor for substantially detecting the travel speed of the table which is moved by the hydraulic cylinder and for outputting a feedback signal; and a control unit for controlling the drive mechanism according to the feedback signal outputted by the speed sensor so that the actual travel speed of the table is equal to a predetermined travel speed for the table.

9 Claims, 2 Drawing Sheets

SLICING APPARATUS WITH WORK-FEEDING MECHANISM IN FEEDBACK CONTROL

BACKGROUND OF THE INVENTION

This invention relates to a slicing apparatus used for cutting a work such as a block of semiconductor material into slices, and, in particular, relates to a slicing apparatus in which a work is moved relative to a blade at a constant cutting speed so as to regulate the cutting force, thereby being cut into slices of an excellent quality.

A known slicing apparatus of the aforementioned type includes: an inside diameter rotary blade of an annular plate-like configuration having an inner peripheral cutting edge and adapted to be rotated at a high speed; a table for carrying a work to be cut; a first work-feeding mechanism for moving the work on the table in a first direction parallel to the axis of the rotary blade to confront the work on the table with the inner peripheral edge of the rotary blade; and a second work-feeding mechanism for moving the table in a second direction parallel to the opposite sides of the blade in order to have the work on the table sliced by the blade.

In the slicing apparatus described above, the second work-feeding mechanism includes a hydraulic cylinder in open loop control. This is because the movement in the second direction of the table is so simple that it is thought not to be necessary to control the travel speed or cutting speed of the table with high accuracy.

However, when a work is sliced by using this slicing apparatus, there arises such a problem that the blade vibrates during the slicing apparatus, and thereby not only the work but also the blade tend to be damaged. The inventors analyzed the cause of the vibration, and have discovered that the blade vibrates because the cutting speed is varied during the cutting operation. The rotary blade is usually set on the apparatus with its sides warped or curved at a predetermined degree to restrain it from vibration. However, this degree of the warp or curvature is varied during the cutting operation when the cutting force varies. This variation in the cutting force is caused by the variation in the cutting speed. Consequently, when the cutting speed varies during the operation, the blade begins to vibrate, resulting in the damage of the blade and the resultant slices of the work. The inventors have also discovered the following reasons for the variation of the cutting speed.

The cutting speed is varied because of:

(1) the abrasion of parts of the slicing apparatus, such as bearings which support the spindle of the blade;

(2) the secular change of viscosity and compressibility of the pressure oil of the hydraulic cylinder; and (3) the variation of an area of the blade's sides in contact with the work during the cutting operation.

The present invention has been made with the background mentioned above.

SUMMARY OF THE INVENTION

Accordingly, it is an object of the present invention to provide a slicing apparatus which is able to move a work on the table at a constant travel speed, thereby producing slices of the work in excellent quality.

Another object of the present invention is to provide a slicing apparatus which is capable of slicing a work smoothly.

With these and other objects in view, the present invention provides a slicing apparatus comprising: an annular plate-like rotary blade adapted to be rotated about an axis thereof and having an inner peripheral cutting edge; a table for carrying a work; first work-feeding means for moving the work on the table in a direction parallel to the axis of the rotary blade; and second work-feeding means for moving the table in a direction parallel to the opposite side of the blade so as to cause the work on the table to be sliced by the blade. The second work feeding means comprises: a hydraulic cylinder operatively connected to the table; pressure oil-supplying means, communicatively connected to the hydraulic cylinder, for supplying the hydraulic cylinder with a pressure oil so that the hydraulic cylinder is actuated; a rotary valve, interposed between the hydraulic cylinder and the oil-supplying means, for controlling the flow rate of the pressure oil to be supplied to the hydraulic cylinder, the rotary valve having a rotary input shaft of which rotational position determines the flow rate of the pressure oil passing through the rotary valve; drive means, operatively connected to the input shaft of the rotary valve, for rotating the input shaft; cutting speed-detecting means for substantially detecting the travel speed of the table moved by the hydraulic cylinder and for outputting a feedback signal; and control means, connected to both the drive means and the speed-detecting means, for controlling the drive means according to the feedback signal from the speed-detecting means so that the actual travel speed of the table is equal to a predetermined travel speed for the table.

With the arrangement mentioned above, the flow rate of the pressure oil supplied to the hydraulic cylinder is adjusted by the operation of the driving means, and the driving means is controlled by the control means according to the feedback signal produced by the cutting speed-detecting means, the feedback signal substantially representing the actual travel speed of the table moved by the hydraulic cylinder. Consequently, the travel speed of the table moved by the hydraulic cylinder is controlled with considerably high accuracy. That is, it is possible, by using this slicing apparatus, to maintain a constant cutting speed during the cutting operation, resulting in slices of a work, of an excellent quality.

It is preferred that the rotary valve has a rotary spool member operatively connected to the input shaft of the rotary valve. In this case, the rotational position of the spool member determines the degree of opening of the rotary valve.

The cutting speed-detecting means may be a linear encoder for detecting the displacement of the table in a direction parallel to the opposite sides of the blade. In this case, the feedback signal outputted by the linear encoder represents the detected displacement of the table, and the control means is a central processors for calculating the actual travel speed of the table on the basis of the feedback signal from the linear encoder.

DETAILED DESCRIPTION OF THE PREFERRED EMBODIMENT

Figure 1:
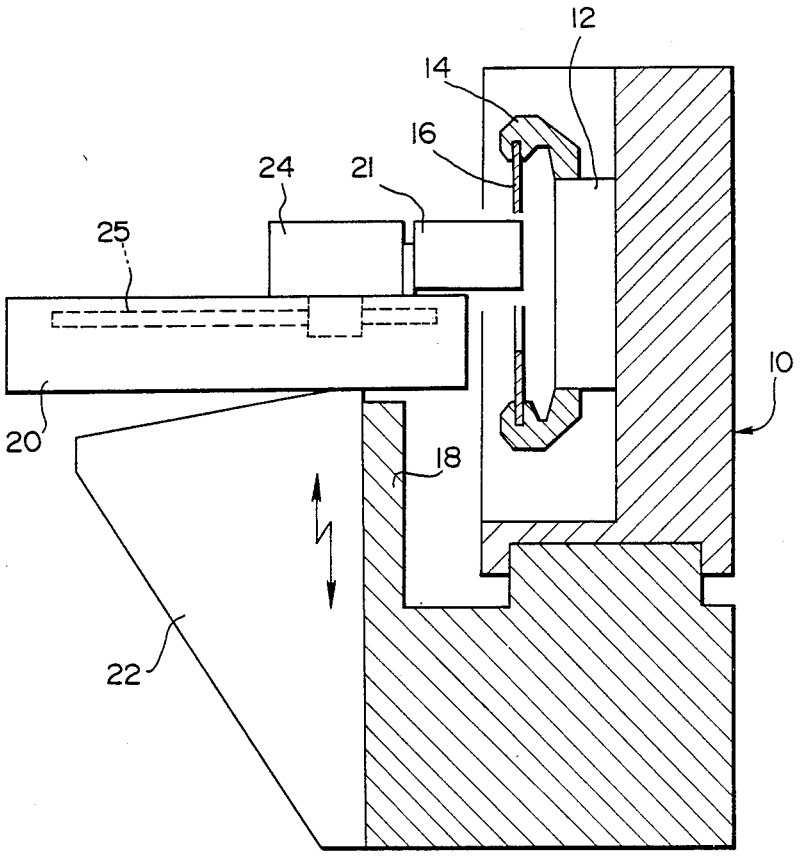
FIG. 1 is a schematic view of a slicing apparatus according to the present invention.

FIG. 1 shows a slicing apparatus according to the present invention. This slicing apparatus has a machine frame 10 on which an annular spindle 12 is disposed for rotation about its axis. The spindle 12 is operatively connected to a drive means such as an electric motor (not shown) so as to be rotated at a high speed. The spindle 12 has a ring-shaped clamp member 14 coaxially fastening the outer periphery of a rotary blade 16 to the spindle 12. The blade 16 is of an annular plate-like configuration and has abrasive grains deposited on the inner periphery thereof for serving as an inner peripheral cutting edge. A guide means in the form of a guide portion 18 is formed on the machine frame 10 and extends in a direction parallel to the opposite sides of the blade 16. A slider 22 is slidably connected to the guide portion 18 for movement along the guide portion 18. A carrying table 20 for carrying an ingot 21 of semiconductor material is mounted on the slider 22 so that, when the slider 22 moves along the guide portion 18, the table 20 moves along with the slider 22. This carrying table 20 has a mounting member 24 slidably connected to the table 20 for movement in a direction parallel to the axis of the blade 16. This mounting member 21 retains the ingot 24 on the table 20 when the ingot 21 is fixed to the mounting member 24, so that the ingot 21 is movable together with the mounting member 24. The mounting member 24 is threadedly engaged with a lead screw 25 which is supported by the table 20 so as to be rotatable about its longitudinal axis. This lead screw 25 extends parallel to the axis of the blade 16 toward the central aperture of the blade 16 and is drivingly connected to suitable means such as a motor (not shown) for rotating the lead screw 25. Accordingly, when the lead screw 25 is rotated, the mounting member 24 is moved in a direction parallel to the axis of the blade 16, and thus the ingot 21 on the table 20 is locatable at a position confronting the inner peripheral cutting edge of the blade 16. That is, the mounting member 24, the lead screw 25 and the like mentioned above constitute a first work-feeding mechanism for moving the ingot 21 on the table 20 in a direction parallel to the axis of the blade 16.

Figure 2:
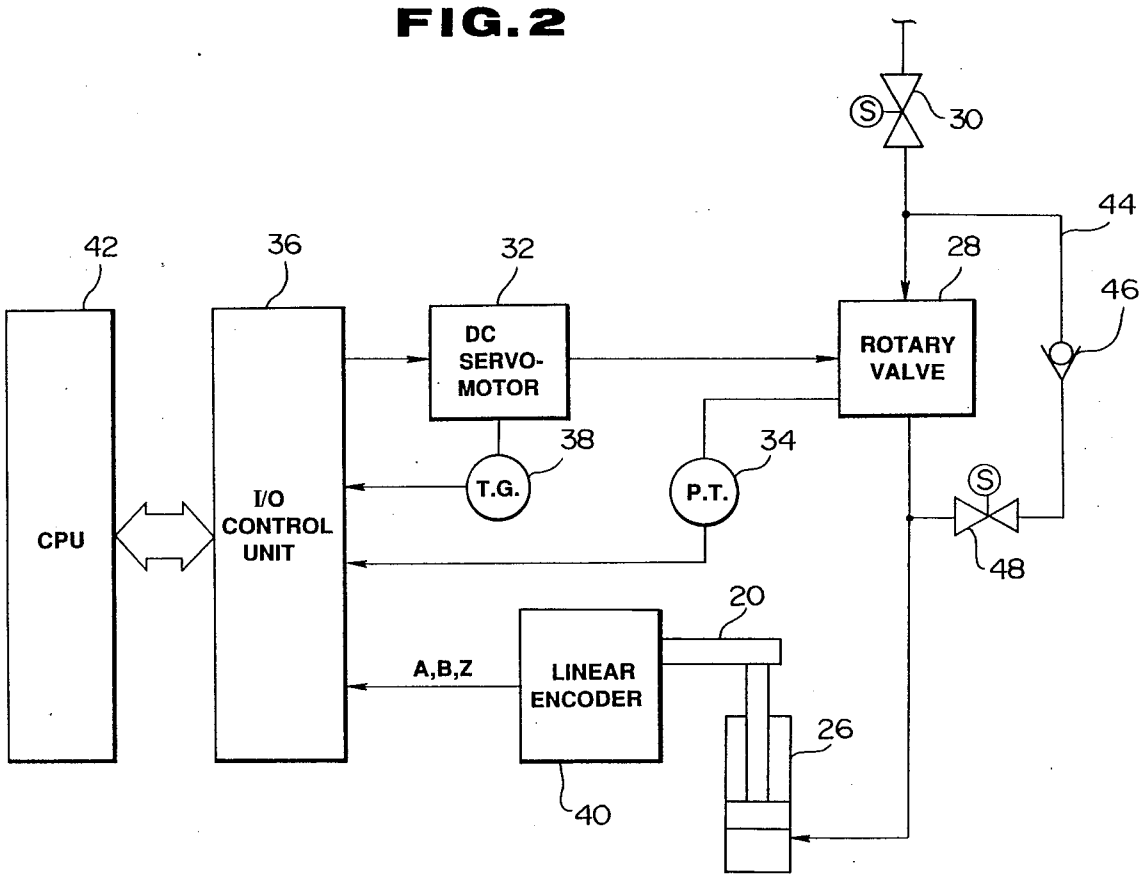
FIG. 2 is a block diagram schematically showing a second work-feeding mechanism of the slicing apparatus in FIG. 1.

A hydraulic cylinder is interposed between the machine frame 10 and the slider 22 so as to move the table 20 in a direction parallel to the opposite sides of the blade 16. That is, the hydraulic cylinder constitute a part of a second work-feeding mechanism for moving the table 20. FIG. 2 schematically illustrates the second work-feeding mechanism, in which the hydraulic cylinder 26 is communicatively connected to a rotary valve 28. This rotary valve 28 is communicatively connected to a hydraulic pump (not shown) and an oil reservoir (not shown) via an electromagnetic valve 30. The rotary valve 28 is, for example, a valve employed in an RSA unit manufactured by Mitsubishi Metal Corporation. More specifically, the rotary valve 28 has a rotatable input shaft (not shown) and a rotary spool (not shown) for opening and closing the rotary valve 28. The rotational position or angular position of the rotary spool determines the degree of opening of the rotary valve 28. The spool is operatively and coaxially connected to the input shaft. Therefore, when the input shaft is rotated, the spool synchronously rotates or turns together with the input shaft, and thus the flow rate of the pressure oil to be supplied to the hydraulic cylinder 26 is varied. The input shaft of the rotary valve 28 is drivingly connected to an output shaft of a dc servomotor 32 via reduction gears (not shown).

A feedback system of the second work-feeding mechanism will now be described.

Angular position-detecting means in the form of a potentiometer 34 is directly connected to the input shaft of the rotary valve 28 to detect the rotational position or angular position of the input shaft and to output a feedback signal representing the detected angular position. An I/O control unit 36 for controlling the operation of the dc servomotor 32 is connected to the potentiometer 34 so as to receive the feedback signal outputted by the potentiometer 34.

Revolution-detecting means in the form of a tachometer generator 38 is connected to the output shaft of the dc servomotor 32 so as to detect the revolution of the dc servomotor's output shaft and to produce a feedback signal representative of the detected revolution. This tachometer generator 38 is also connected to the I/O control unit 36 so that the control unit 36 receive the feedback signal from the tachometer generator 38. According to the feedback signal from the tachometer generator 38, the control unit 36 control the revolution of the servomotor's output shaft, and thereby it is possible to compensate the characteristic of the servomotor 32.

Furthermore, cutting speed-detecting means in the form of a linear encoder 40 is connected to the carrying table 20 to detect the displacement of the table 20 in a direction parallel to the opposite sides of the blade 16, and is also connected to the I/O control unit 36. This linear encoder 40 outputs a feedback signal representing the detected displacement of the table 20. This feedback signal includes two pulse trains, namely, a train of pulses A and a train of pulses B, the pulse trains having a phase difference, for example, of 90 degrees. Therefore, when the direction of the table's movement is reversed, the order of the pulses A and B to be outputted is reversed. The linear encoder 40 also outputs a zero point signal Z when the table 20 is at its initial position or lower most position.

The feedback signals outputted by those detecting means 34, 38 and 40 are supplied to the I/O control unit 36. The control unit 36 calculates the actual travel speed (i.e., the cutting speed) of the table 20 on the basis of the feedback signal from the linear encoder 40, and controls the dc servomotor 32 so that the actual travel speed of the table 20 is equal to a preset travel speed stored in a CPU 42 which is connected to the control unit 36. More specifically, by controlling the servomotor 32 properly, the degree of opening of the rotary valve 28 is adjusted to a suitable degree for the hydraulic cylinder 26 to move the table 20 at the preset travel speed. The CPU 42 is, for example, a microcomputer for supplying a command signal representative of the preset travel speed, to the I/O control unit 36. Needless to say, the I/O control unit 36 and the CPU 42 constitutes control means for the servomotor 32.

A piping 44 defining a passage for the pressure oil of the hydraulic cylinder 26 is disposed to interconnect the cylinder 26 with the electromagnetic valve 30. This piping 44 is provided with a check valve 46 for limiting the flow of the pressure oil in the piping 44 to a single direction such that the pressure oil flows toward the electromagnetic valve 30. The piping 44 is also provided with a solenoid valve 48 disposed at an upstream position relative to the check valve 46. Accordingly, when the rotary valve 28 is closed and the solenoid valve 48 is opened, the pressure oil flows back to the oil reservoir through the piping 44 by turning the cylinder 26 for its contracting movement.

The operation of the second work-feeding mechanism mentioned above will now be described.

To control the upward movement, as viewed in FIGS. 1 and 2, of the table 20, an on/off switch (not shown) of the second work-feeding mechanism is turned on. Then, the solenoid valve 48 is closed, and the CPU 42 supplies a command signal to the I/O control unit 36, the command signal representing a preset travel speed for the table 20. The control unit 36, then, actuates the dc servomotor 32 so that the output shaft of the servomotor 32 is rotated an angle in conformity with the command signal. As a result, the input shaft of the rotary valve 28 is turned an angle corresponding to the angle of rotation of the servomotor 32, and thereby the degree of opening of the valve 28 is adjusted to a prescribed degree. That is, the flow rate of the pressure oil passing through the rotary valve 28 is adjusted to a prescribed degree. The pressure oil is, thus, supplied to the hydraulic cylinder 26 at the prescribed flow rate, and extends the cylinder 26 to move the table 20 upward at the preset travel speed.

Subsequently, the linear encoder 40 detects the displacement of the table 20, and transmits a feedback signal representing the detected displacement to the I/O control unit 36. The control unit 36, then, calculates the travel speed of the table 20, and compares the calculated speed with the preset travel speed for the table 20. If the calculated travel speed is different from the preset speed, the control unit 36 actuates the servomotor 32 for rotation of the servomotor's output shaft in one or the other direction, so that the degree of opening of the rotary valve 28 is varied and the actual travel speed of the table 20 is equal to the preset travel speed.

As is described above, the actual travel speed of the table 20, that is, the cutting speed is controlled so that it is equal to the preset speed. Consequently, a slice of a work, of an excellent quality is obtained by using this slicing apparatus.

When a slice of the work is cut off, the linear encoder 40 detects the upper most position of the table 20 and output a signal representing the end of the slicing operation. Then, according to the signal outputted by the linear encoder 40, the control unit 36 actuates the servomotor 32 to that the output shaft of the servomotor 32 is rotated until the rotary valve 28 is closed. At the same time, the solenoid valve 48 is opened. Accordingly, the pressure oil in the hydraulic cylinder 26 flows back to the oil reservoir through the piping 44, resulting in the downward movement of the table 20. Needless to say, the feedback signal outputted by the potentiometer 34 confirms that the rotary valve 28 is closed.

Subsequently, when the table 20 is moved to its lower most position, the linear encoder 40 produces a zero point signal Z. According to this signal Z, the control unit 36 actuates the motor of the first work-feeding mechanism so that the ingot 21 is moved a predetermined length along the axis of the blade 16, the predetermined length being equal to the thickness of a slice to be cut off. Thereafter, the control unit 36 actuates the servomotor 32 so that the rotary valve 28 is, again, opened suitably for upward movement of the table 20, whereby another slicing operation is achieved.

What is claimed is:

1. A slicing apparatus for cutting a work into slices comprising: an inside diameter rotary blade of an annular plate-like configuration, the rotary blade being adapted to be rotated about an axis thereof and having an inner peripheral cutting edge formed on an inner periphery thereof; a table for carrying the work; first work-feeding means for moving the work on the table in a direction parallel to the axis of the rotary blade so as to confront the work with the inner peripheral cutting edge of the rotary blade; and second work-feeding means for moving the table in a direction parallel to the opposite sides of the blade so as to cause the work on the table to be sliced by the blade, the second work feeding means comprising:

a hydraulic cylinder operatively connected to the table;

pressure oil-supplying means, communicatively connected to the hydraulic cylinder, for supplying the hydraulic cylinder with a pressure oil so that the hydraulic cylinder is actuated;

a rotary valve, interposed between the hydraulic cylinder and the oil-supplying means, for controlling the flow rate of the pressure oil to be supplied to the hydraulic cylinder, the rotary valve having a rotary input shaft of which rotational position determines the flow rate of the pressure oil passing through the rotary valve;

drive means, operatively connected to the input shaft of the rotary valve, for rotating the input shaft;

cutting speed-detecting means for substantially detecting the travel speed of the table which is moved by the hydraulic cylinder and for outputting a feedback signal; and control means, connected to both the drive means and the speed-detecting means, for controlling the drive means according to the feedback signal outputted by the speed-detecting means so that the actual travel speed of the table is equal to a predetermined constant travel speed for the table.

2. A slicing apparatus according to claim 1, wherein the rotary valve further has a rotary spool member of which rotational position determines the degree of opening of the rotary valve, the spool member being operatively connected to the input shaft of the rotary valve.

3. A slicing apparatus according to claim 2, wherein the cutting speed-detecting means comprises a linear encoder for detecting the displacement of the table in a direction parallel to the opposite sides of the blade, wherein the feedback signal outputted by the cutting speed-detecting means represents the detected displacement of the table, and wherein the control means comprises a central processors for calculating the actual travel speed of the table on the basis of the feedback signal from the linear encoder.

4. A slicing apparatus for cutting a work into slices comprising: an inside diameter rotary blade of an annular plate-like configuration, the rotary blade being adapted to be rotated about an axis thereof and having an inner peripheral cutting edge formed on an inner periphery thereof; a table for carrying the work; first work-feeding means for moving the work on the table in a direction parallel to the axis of the rotary blade so as to confront the work with the inner peripheral cutting edge of the rotary blade; and second work-feeding means for moving the table in a direction parallel to the opposite side of the blade so as to cause the work on the table to be sliced by the blade; the second work feeding means comprising:

a hydraulic cylinder operatively connected to the table;

pressure-oil-supplying means, communicatively connected to the hydraulic cylinder, for supplying the hydraulic cylinder with a pressure oil so that the hydraulic cylinder is actuated;

a rotary valve, interposed between the hydraulic cylinder and the oil-supplying means, for controlling the flow rate of the pressure oil to be supplied to the hydraulic cylinder, the rotary valve having a rotary input shaft of which rotational position determines the flow rate of the pressure oil passing through the rotary valve;

drive means, operatively connected to the input shaft of the rotary valve, for rotating the input shaft;

cutting speed-detecting means for substantially detecting the travel speed of the table which is moved by the hydraulic cylinder and for outputting a feedback singal;

angular position-detecting means, connected to the input shaft of the rotary valve, for detecting the rotational position of the input shaft and for supplying a feedback signal representing the detected rotational position; and control means, connected to the drive means, the speed-detecting means and the position-detecting means, to control the drive means according to the feedback signal from the angular position-detecting means and the feedback signal from the speed-detecting means so that the actual travel speed of the table is equal to a predetermined travel speed for the table.

5. A slicing apparatus according to claim 4, wherein the angular position-detecting means comprises a potentiometer.

6. A slicing apparatus according to claim 2, wherein the drive means comprises a dc servomotor having an output shaft.

7. A slicing apparatus for cutting a work into slices comprising: an inside diameter rotary blade of an annular plate-like configuration, the rotary blade being adapted to be rotated about an axis thereof and having an inner peripheral cutting edge formed on an inner periphery thereof; a table for carrying the work; first work-feeding means for moving the work on the table in a direction parallel to the axis of the rotary blade so as to confront the work with the inner peripheral cutting edge of the rotary blade; and second work-feeding means for moving the table in a direction parallel to the opposite sides of the blade so as to cause the work on the table to be sliced by the blade, the second work feeding means comprising:

a hydraulic cylinder operatively connected to the table;

pressure oil-supplying means, communicatively connected to the hydraulic cylinder, for supplying the hydraulic cylinder with a pressure oil so that the hydraulic cylinder is actuated;

a rotary valve, interposed between the hydraulic cylinder and the oil-supplying means, for controlling the flow rate of the pressure oil to be supplied to the hydraulic cylinder, the rotary valve having a rotary input shaft of which rotational position determines the flow rate of the pressure oil passing through the rotary valve;

drive means having an output shaft operatively connected to the input shaft of the rotary valve, for rotating the input shaft;

cutting speed-detecting means for substantially detecting the travel speed of the table which is moved by the hydraulic cylinder and for outputting a feedback signal;

revolution-detecting means, connected to the output shaft of the drive means, for detecting the revolution of the output shaft and for supplying a feedback signal representative of the detected revolution; and control means, connected to the drive means, the speed-detecting means and the revolution-detecting means, to control the drive means according to the feedback signal from the revolution-detecting means and the feedback signal from the speed-detecting means so that the actual travel speed of the table is equal to a predetermined travel speed for the table.

8. A slicing apparatus according to claim 7, wherein the revolution-detecting means comprises a tachometer generator.

9. A slicing apparatus according to claim 7, wherein the drive means is a dc servomotor.

* * * * *

UNITED STATES PATENT AND TRADEMARK OFFICE

CERTIFICATE OF CORRECTION

PATENT NO. : 4,932,389

DATED : June 12, 1990

INVENTOR(S) : Yukihiro Saeki, et al.

It is certified that error appears in the above-identified patent and that said Letters Patent is hereby corrected as shown below:

In the Abstract, line 2: "axle" should read as --axis--

Column 1, line 40: "vibration." should read as --vibrating.--

Column 5, line 49: "to" should read as --so--

Signed and Sealed this

Twelfth Day of November, 1991

*Attest:*

HARRY F. MANBECK, JR.

*Attesting Officer*

*Commissioner of Patents and Trademarks*